US008470103B2

(12) United States Patent
Inoue et al.

(10) Patent No.: US 8,470,103 B2
(45) Date of Patent: Jun. 25, 2013

(54) METHOD OF MAKING A CU-BASE BULK AMORPHOUS ALLOY

(75) Inventors: Akihisa Inoue, Sendai (JP); Wei Zhang, Sendai (JP); Tao Zhang, Sendai (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 967 days.

(21) Appl. No.: 12/292,723

(22) Filed: Nov. 25, 2008

(65) Prior Publication Data

US 2009/0078342 A1 Mar. 26, 2009

Related U.S. Application Data

(62) Division of application No. 10/451,143, filed on Dec. 1, 2003, now abandoned.

(30) Foreign Application Priority Data

Dec. 27, 2000 (JP) ..... 2000-397007
Aug. 30, 2001 (JP) ..... 2001-262438

(51) Int. Cl.
*C22C 45/00* (2006.01)

(52) U.S. Cl.
USPC ..... 148/561; 148/304

(58) Field of Classification Search
USPC ..... 148/561, 304
See application file for complete search history.

(56) References Cited

U.S. PATENT DOCUMENTS

| | | | |
|---|---|---|---|
| 5,368,659 A | 11/1994 | Peker et al. | |
| 5,618,359 A | 4/1997 | Lin et al. | |
| 5,797,443 A | 8/1998 | Lin et al. | |

FOREIGN PATENT DOCUMENTS

| | | | |
|---|---|---|---|
| JP | 59-126739 A | | 7/1984 |
| JP | 60-59034 A | | 4/1985 |
| JP | 7-0419 18 | | 2/1995 |
| JP | 7-173556 A | | 7/1995 |
| JP | 8-253847 A | | 10/1996 |
| JP | 08253847 A | * | 10/1996 |
| JP | 9-20968 A | | 1/1997 |
| JP | 9-59750 A | | 3/1997 |
| JP | 10-175082 A | | 6/1998 |
| JP | 11-61289 A | | 3/1999 |
| JP | 11-71660 A | | 3/1999 |
| JP | 11-71661 A | | 3/1999 |
| JP | 11-286069 A | | 10/1999 |
| JP | 11286069 A | * | 10/1999 |
| JP | 2000-129378 A | | 5/2000 |
| JP | 2000-160308 A | | 6/2000 |
| SU | 1771133 A1 | | 8/1995 |

OTHER PUBLICATIONS

European Office Action dated Dec. 11, 2009, issued in corresponding European Patent Application No. 01 272 797.0.

(Continued)

*Primary Examiner* — Sikyin Ip
(74) *Attorney, Agent, or Firm* — Westerman, Hattori, Daniels & Adrian, LLP

(57) ABSTRACT

The present invention provides Cu-base amorphous alloys containing an amorphous phase of 90% or more by volume fraction. The amorphous phase has a composition represented by the formula: $Cu_{100-a-b}(Zr+Hf)_aTi_b$ or $Cu_{100-a-b-c-d}(Zr+Hf)_a Ti_bM_cT_d$, wherein M is one or more elements selected from Fe, Cr, Mn, Ni, Co, Nb, Mo, W, Sn, Al, Ta and rare earth elements, T is one or more elements selected from the group consisting of Ag, Pd, Pt and Au, and a, b, c and d are atomic percentages falling within the following ranges: $5 \leqq a \leqq 55$, $0 \leqq b \leqq 45$, $30 \leqq a+b \leqq 60$, $0.5 \leqq c \leqq 5$, $0 \leqq d \leqq 10$. The Cu-base amorphous alloy has a high glass-forming ability as well as excellent mechanical properties and formability, and can be formed as a rod or plate material with a diameter or thickness of 1 mm or more and an amorphous phase of 90% or more by volume fraction, through a metal mold casting process.

4 Claims, 2 Drawing Sheets

OTHER PUBLICATIONS

A. Inoue et al.; Materials Transactions, JIM, vol. 37, No. 7, pp. 1343-1349, (1996).

K. Shirakawa et al.; Crystallization and Electrical Properties of Amorphous Cu-Ag-P Alloys—pp. 255-265.

H. Yamaguchi et al.; Materials Science and Engineering, A181/A182, pp. 1383-1386. (1994).

A. Inoue et al.; Materials Transactions, Jim, vol. 38, No. 4, pp. 359-362, (1997).

* cited by examiner

METHOD OF MAKING A CU-BASE BULK AMORPHOUS ALLOY

CROSS-REFERENCE TO RELATED APPLICATIONS

This application is a divisional of prior application Ser. No. 10/451,143 filed on Dec. 1, 2003, now abandoned, the benefit of which is claimed under 35 U.S.C. §120.

TECHNICAL FIELD

The present invention relates to a Cu-base amorphous alloy having a high glass-forming ability as well as excellent mechanical properties and formability.

BACKGROUND ART

It is well known that an alloy in its molten state can be rapidly cooled or quenched to obtain an amorphous solid in various forms, such as thin strip, filament or powder/particle. An amorphous alloy thin-strip or powder can be prepared through various processes, such as a single-roll process, a twin-roll process, an in-rotating liquid spinning process and an atomization process, which can provide a high quenching rate. Heretofore, a number of Fe, Ti, Co, Zr, Ni, Pd or Cu-base amorphous alloys have been developed, and their specific properties such as excellent mechanical properties and high corrosion resistance have been clarified.

In regard to Cu-base amorphous alloys related to the present invention, researches have been mainly made on binary alloys such as Cu—Ti and Cu—Zr, or ternary alloys such as Cu—Ni—Zr, Cu—Ag—RE, Cu—Ni—P, Cu—Ag—P, Cu—Mg—RE and Cu—(Zr, RE, Ti)—(Al, Mg, Ni) (Japanese Patent Laid-Open Publication Nos. H07-41918, H07-173556, H09-59750 and H11-61289; Mater., Trans. JIM, Vol. 37, No. 7 (1996) 1343-1349; Sic. Rep. RITU. A28 (1980) 255-265; Mater. Sic. Eng. A181-182 (1994) 1383-1392; Mater. Trans. JIM, Vol. 38, No. 4 (1997) 359-362).

While the above Cu-base amorphous alloys have been researched based largely on thin-strip samples prepared through the aforementioned single-roll/liquid quenching process, research and development on Cu-base bulk amorphous alloys for practical use, or Cu-base bulk amorphous alloys excellent in glass-forming ability, has made few advance.

DISCLOSURE OF THE INVENTION

It is known that an amorphous alloy undergoing a glass transition with a wide supercooled liquid region and having a high reduced-glass-transition temperature (Tg/Tm) exhibits an excellent stability against crystallization and a high glass-forming ability. The alloy having such a high glass-forming ability can be formed as a bulk amorphous alloy through a metal mold casting process. It is also known that when a specific amorphous alloy is heated, the viscosity of the amorphous alloy is sharply lowered during transition to the supercooled liquid state before crystallization.

Such an amorphous alloy can be formed in an arbitrary shape through a closed forging process or the like by taking advantage of the lowered viscosity in the supercooled liquid state. Thus, it can be said that an alloy having a wide supercooled liquid region and a high reduced-glass-transition temperature (Tg/Tm) exhibits a high glass-forming ability and an excellent formability.

The conventional Cu-base amorphous alloys have a poor glass-forming ability, and have been able to be formed only in limited forms, such as thin strip, powder and thin line, through a liquid quenching process. In addition, they have no stability at high temperature, and have difficulty in being converted into a final product with a desired shape, resulting in their quite limited industrial applications.

In view of the above circumstance, it is an object of the present invention to provide a Cu-base amorphous alloy having a high glass-forming ability as well as excellent mechanical properties and formability.

Through various researches on the optimal composition of Cu-base alloy for achieving the above object, the inventors found that a Cu-base alloy having a specific composition containing Zr and/or Hf can be molten and then rapidly solidified from the liquid state to obtain a Cu-base amorphous alloy having a high glass-forming ability as well as excellent mechanical properties and formability, such as a rod-shaped (or plate-shaped) amorphous-phase material with 1 mm or more of diameter (or thickness). Based on this knowledge, the inventors have completed the present invention.

Specifically, according to a first aspect of the present invention, there is provided a Cu-base amorphous alloy comprising an amorphous phase of 90% or more by volume fraction. The amorphous phase has a composition represented by the following formula:

$$Cu_{100-a-b}(Zr+Hf)_aTi_b,$$

wherein a and b are atomic percentages falling within the following ranges: $5<a\leqq55$, $0\leqq b\leqq45$, $30<a+b\leqq60$. In this formula, (Zr+Hf) means Zr and/or Hf.

According to a second aspect of the present invention, there is provided a Cu-base amorphous alloy comprising an amorphous phase of 90% or more by volume fraction. The amorphous phase has a composition represented by the following formula:

$$Cu_{100-a-b}(Zr+Hf)_aTi_b,$$

wherein a and b are atomic percentages falling within the following ranges: $10<a\leqq40$, $5\leqq b\leqq30$, $35\leqq a+b\leqq50$.

According to a third aspect of the present invention, there is provided a Cu-base amorphous alloy comprising an amorphous phase of 90% or more by volume fraction. The amorphous phase has a composition represented by the following formula:

$$Cu_{100-a-b}(Zr+Hf)_aTi_bM_cT_d,$$

wherein M is one or more elements selected from the group consisting of Fe, Cr, Mn, Ni, Co, Nb, Mo, W, Sn, Al, Ta and rare earth elements, T is one or more elements selected from the group consisting of Ag, Pd, Pt and Au, and a, b, c and d are atomic percentages falling within the following ranges: $5<a\leqq55$, $0\leqq b\leqq45$, $30<a+b\leqq60$, $0.5\leqq c\leqq5$, $0\leqq d\leqq10$.

According to a fourth aspect of the present invention, there is provided a Cu-base amorphous alloy comprising an amorphous phase of 90% or more by volume fraction. The amorphous phase has a composition represented by the following formula:

$$Cu_{100-a-b}(Zr+Hf)_aTi_bM_cT_d,$$

wherein M is one or more elements selected from the group consisting of Fe, Cr, Mn, Ni, Co, Nb, Mo, W, Sn, Al, Ta and rare earth elements, T is one or more elements selected from the group consisting of Ag, Pd, Pt and Au, and a, b, c and d are atomic percentages falling within the following ranges: $10<a\leqq40$, $5\leqq b\leqq30$, $35\leqq a+b\leqq50$, $0.5\leqq c\leqq5$, $0\leqq d\leqq10$.

The above Cu-base amorphous alloys of the present invention may have a supercooled liquid region with a temperature interval $\Delta Tx$ of 25 K or more. The temperature interval is represented by the following formula: $\Delta Tx=Tx-Tg$, wherein Tx is a crystallization temperature of the alloy, and Tg is a glass transition temperature of the alloy.

The Cu-base amorphous alloys of the present invention may have a reduced glass transition temperature of 0.56 or more. The reduced glass transition temperature is represented by the following formula: Tg/Tm, wherein Tg is a glass transition temperature of the alloy, and Tm is a melting temperature of the alloy.

The Cu-base amorphous alloys of the present invention may be formed as a rod or plate material having a diameter or thickness of 1 mm or more and an amorphous phase of 90% or more by volume fraction, through a metal mold casting process.

The Cu-base amorphous alloys of the present invention may have a compressive fracture strength of 1800 MPa or more, an elongation of 1.5% or more, and a Young's modulus of 100 GPa or more.

The term "supercooled liquid region" herein is defined by the difference between a glass transition temperature of the alloy and a crystallization temperature (or an initiation temperature of crystallization) of the alloy, which are obtained from a differential scanning calorimetric analysis performed at a heating rate of 40 K/minute. The "supercooled liquid temperature region" is a numerical value indicative of resistibility against crystallization which is equivalent to thermal stability of amorphous state, glass-forming ability or formability. The alloys of the present invention have a supercooled liquid temperature region $\Delta Tx$ of 25 K or more.

The term "reduced glass transition temperature" herein is defined by a ratio of the glass transition temperature (Tg) to a melting temperature (Tm) of the alloy which is obtained from a differential scanning calorimetric analysis (DTA) performed at a heating rate of 5 K/minute. The "reduced glass transition temperature" is a numerical value indicative of the glass-forming ability.

BEST MODE FOR CARRYING OUT THE INVENTION

One embodiment of the present invention will now be described.

In a Cu-base amorphous alloy of the present invention, Zr and/or Hf are basic elements for forming an amorphous material. The content of Zr and/or Hf is set in the range of greater than 5 atomic % up to 55 atomic %, preferably in the range of 10 to 40 atomic %. If the content of Zr and/or Hf is reduced to 5 atomic % or less or increased to greater than 55 atomic %, the supercooled liquid region $\Delta Tx$ and the reduced glass transition temperature Tg/Tm will be reduced, resulting in deteriorated glass-forming ability.

Element Ti is effective to enhance the glass-forming ability to a large degree. However, if the content of Ti is increased to greater than 45 atomic %, the supercooled liquid region $\Delta Tx$ and the reduced glass transition temperature Tg/Tm will be reduced, resulting in deteriorated glass-forming ability. Thus, the content of Ti is set in the range of 0 to 45 atomic %, preferably 5 to 30 atomic %.

The total of the content of Zr and/or Hf and the content of Ti is set in the range of greater than 30 atomic % up to 60 atomic %. If the total content of these elements is reduced to 30 atomic % or increased to greater than 60 atomic %, the glass-forming ability will be deteriorated, and no bulk material can be obtained. Preferably, the total content is set in the range of 35 to 50 atomic %.

Cu of up to 10 atomic % may be substituted with one or more element selected from the group consisting of Ag, Pd, Au and Pt. This substitution can slightly increase the temperature interval of the supercooled liquid region. If greater than 10 atomic % of Cu is substituted, the supercooled liquid region will be reduced to less than 25 K, resulting in deteriorated glass-forming ability.

While a small amount of one or more elements selected from the group consisting of Fe, Cr, Mn, Ni, Co, Nb, Mo, W, Sn, Al, Ta and rare earth elements (Y, Gd, Tb, Dy, Sc, La, Ce, Pr, Nd, Sm, Eu and Ho) may be effectively added to provide an enhanced mechanical strength, the glass-forming ability is deteriorated as the addition of these elements is increased. Thus, the content of these element is preferably set in the range of 0.5 to 5 atomic %.

Figure 1:
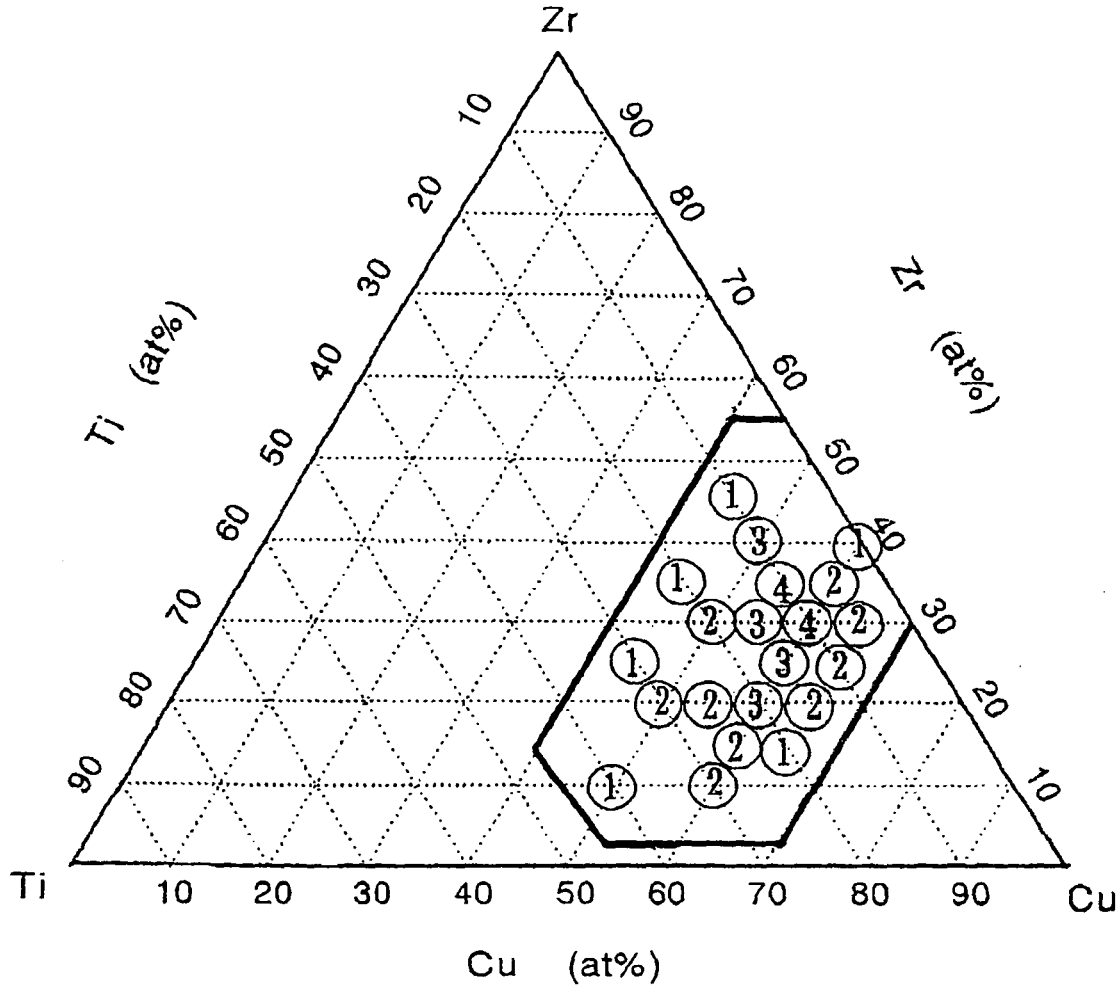
FIG. 1 is a graph showing a composition range of Cu—Zr—Ti ternary alloys capable of forming a bulk amorphous material and the critical thickness (unit: mm) of the bulk amorphous materials.
Figure 2:
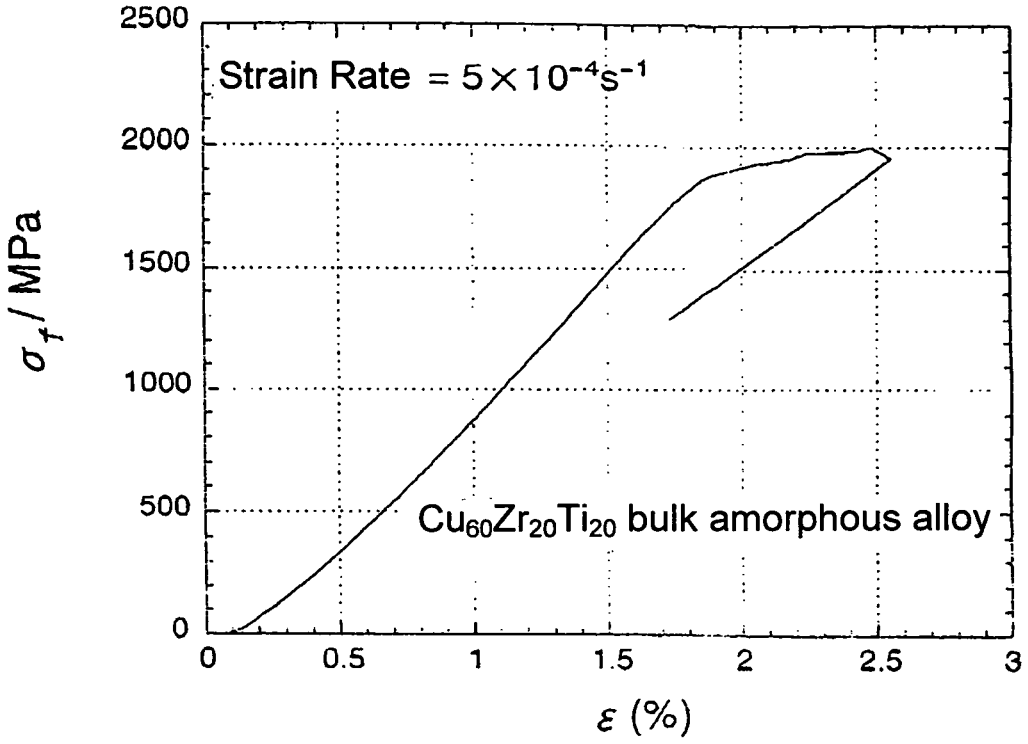
FIG. 2 is a graph showing a stress-strain curve in a compression test of a $Cu_{60}Zr_{20}Ti_{20}$ bulk amorphous alloy having a diameter of 2 mm.

FIG. 1 shows a composition range of Cu—Zr—Ti ternary alloys capable of forming a bulk amorphous material and the critical thickness of the bulk amorphous materials. The composition range capable of forming a bulk amorphous material (having a diameter of 1 mm or more) is shown by the solid line. The numeral in the circle indicates the maximum thickness (unit: mm) of the bulk amorphous materials to be formed in the bulk amorphous materials. FIG. 2 shows a stress-strain curve in a compression test of a $Cu_{60}Zr_{20}Ti_{20}$ bulk amorphous alloy. This alloy has a compressive fracture strength of about 2000 MPa, an elongation of 2.5%, and a Young's modulus of 122 GPa.

The Cu-base amorphous alloy of the present invention can be cooled and solidified from its molten state through various processes, such as a single-roll process, a twin-roll process, an in-rotating liquid spinning process and an atomization process, to provide an amorphous solid in various forms, such as thin strip, filament or powder/particle. The Cu-base amorphous alloys of the present invention can also be formed as a bulk amorphous alloy having an arbitrary shape through not only the above conventional processes but also a process of filling a molten metal in a metal mold and casting therein by taking advantage of its high glass-forming ability.

For example, in a typical metal mold casting process, a mother alloy prepared to have the alloy composition of the present invention is molten in a silica tube under argon atmosphere. Then, the molten alloy is filled in a copper mold at an injection pressure of 0.5 to 1.5 $kg\cdot f/cm^2$, and solidified so as to obtain an amorphous alloy ingot. Alternatively, any other suitable method such as a die-casting process or a squeeze-casting process may be used.

EXAMPLE

Examples of the present invention will be described below. For each of materials having alloy compositions as shown in Table 1 (Inventive Examples 1 to 17 and Comparative Examples 1 to 4), a corresponding mother alloy was molten through an arc-melting process, and then a thin-strip sample of about 20 μm thickness was prepared through a single-roll/liquid quenching process. Then, the glass transition temperature (Tg) and the crystallization temperature (Tx) of the thin-strip sample were measured by a differential scanning calorimeter (DSC). Based on these measured values, the supercooled liquid region ΔTx (=Tx−Tg) of the thin-strip sample was calculated. The melting temperature (Tm) of the sample was also measured by a differential scanning calorimetric analysis (DTA). Then, the reduced glass transition temperature (Tg/Tm) of the sample was calculated from the obtained glass transition temperature and the melting temperature.

Further, a rod-shaped sample of 1 mm diameter was prepared for each of the above materials, and the amorphous phase in the rod-shaped sample was determined through an X-ray diffraction method. The volume fraction (Vf-amo.) of the amorphous phase in the sample was also evaluated by comparing the calorific value of the sample during crystallization with that of a completely vitrified thin strip of about 20 μm thickness, by use of DSC. These evaluation results are shown in Table 1. Further, a compression test piece was prepared for each of the above materials, and the test piece was subjected to a compression test using an Instron-type testing machine to evaluate the compressive fracture strength (σf), the Young's modulus (E) and the elongation (ϵ) of the test piece. The Vickers hardness (Hv) was also measured. These evaluation results are shown in Table 2.

TABLE 1

| | Alloy Composition (at %) | Tg (K) | Tx (K) | Tx − Tg (K) | Tg/Tm | Vf-Amo. (%) |
|---|---|---|---|---|---|---|
| Inventive Example 1 | $Cu_{65}Zr_{25}Ti_{10}$ | 726 | 765 | 39 | 0.58 | 100 |
| Inventive Example 2 | $Cu_{60}Zr_{40}$ | 722 | 777 | 55 | 0.60 | 91 |
| Inventive Example 3 | $Cu_{60}Zr_{30}Ti_{10}$ | 713 | 750 | 37 | 0.62 | 100 |
| Inventive Example 4 | $Cu_{60}Zr_{20}Ti_{20}$ | 708 | 743 | 35 | 0.63 | 100 |
| Inventive Example 5 | $Cu_{60}Zr_{10}Ti_{30}$ | 688 | 719 | 31 | 0.58 | 100 |
| Inventive Example 6 | $Cu_{55}Zr_{35}Ti_{10}$ | 680 | 727 | 47 | 0.59 | 100 |
| Inventive Example 7 | $Cu_{65}Hf_{25}Ti_{10}$ | 760 | 797 | 37 | 0.57 | 100 |
| Inventive Example 8 | $Cu_{60}Hf_{30}Ti_{10}$ | 747 | 814 | 67 | 0.61 | 100 |
| Inventive Example 9 | $Cu_{60}Hf_{20}Ti_{20}$ | 730 | 768 | 38 | 0.62 | 100 |
| Inventive Example 10 | $Cu_{60}Hf_{10}Ti_{30}$ | 696 | 731 | 35 | 0.59 | 100 |
| Inventive Example 11 | $Cu_{55}Hf_{30}Ti_{15}$ | 727 | 785 | 58 | 0.59 | 100 |
| Inventive Example 12 | $Cu_{60}Zr_{15}Hf_{15}Ti_{10}$ | 729 | 784 | 55 | 0.61 | 100 |
| Inventive Example 13 | $Cu_{60}Zr_{10}Hf_{10}Ti_{20}$ | 716 | 753 | 37 | 0.63 | 100 |
| Inventive Example 14 | $Cu_{60}Zr_{28}Ti_{10}Nb_2$ | 724 | 757 | 33 | 0.59 | 95 |
| Inventive Example 15 | $Cu_{60}Zr_{27}Ti_{10}Sn_3$ | 837 | 877 | 40 | 0.61 | 95 |
| Inventive Example 16 | $Cu_{60}Zr_{27}Ti_{10}Ni_3$ | 719 | 754 | 35 | 0.60 | 94 |
| Inventive Example 17 | $Cu_{60}Zr_{25}Ti_{10}Ni_5$ | 708 | 749 | 41 | 0.60 | 100 |
| Comparative Example 1 | $Cu_{70}Zr_{20}Ti_{10}$ | | 746 | | | 50< |
| Comparative Example 2 | $Cu_{70}Hf_{20}Ti_{10}$ | | 771 | | | 50< |
| Comparative Example 3 | $Cu_{60}Zr_{20}Ti_{10}Ni_{10}$ | | 762 | | | 50< |
| Comparative Example 4 | $Cu_{60}Ti_{40}$ | | 694 | | | 50< |

As seen in Table 1, each of the amorphous alloys of Inventive Examples exhibited a supercooled liquid region ΔTx (=Tx−Tg) of 25 K or more and a reduced glass transition temperature (Tg/Tm) of 0.56 or more, and could be readily formed as an amorphous alloy rod of 1 mm diameter.

In contrast, each of the amorphous alloys of Comparative Examples 1 and 2, in which the total of the content of Zr and/or Hf and the content of Ti is 30 atomic %, exhibited no glass transition, and no amorphous alloy rod of 1 mm diameter could be formed therefrom due to its poor glass-forming ability. The amorphous alloy of Comparative Example 3, in which the content of Ni is 10 atomic %, exhibited no glass transition, and no amorphous alloy rod of 1 mm diameter could be formed therefrom due to its poor glass-forming ability. While the amorphous alloy of Comparative Example 4 containing no basic element Zr and/or Hf was vitrified in the form of a ribbon prepared through a single-roll process at a high cooling rate, no amorphous alloy rod of 1 mm diameter could be formed therefrom, and the compression test could not be conducted.

TABLE 2

| | Alloy Composition (at %) | σ f (MPa) | E (GPa) | ϵ (%) | Hv |
|---|---|---|---|---|---|
| Inventive Example 1 | $Cu_{65}Zr_{25}Ti_{10}$ | 1970 | 108 | 2.0 | 603 |
| Inventive Example 2 | $Cu_{60}Zr_{40}$ | 1880 | 102 | 2.7 | 555 |
| Inventive Example 3 | $Cu_{60}Zr_{30}Ti_{10}$ | 2115 | 124 | 3.2 | 504 |
| Inventive Example 4 | $Cu_{60}Zr_{20}Ti_{20}$ | 2015 | 140 | 2.6 | 556 |
| Inventive Example 5 | $Cu_{60}Zr_{10}Ti_{30}$ | 2010 | 135 | 1.7 | 576 |
| Inventive Example 6 | $Cu_{55}Zr_{35}Ti_{10}$ | 1860 | 112 | 2.8 | 567 |
| Inventive Example 7 | $Cu_{65}Hf_{25}Ti_{10}$ | 2145 | 142 | 1.8 | 698 |
| Inventive Example 8 | $Cu_{60}Hf_{30}Ti_{10}$ | 2143 | 134 | 1.9 | 592 |
| Inventive Example 9 | $Cu_{60}Hf_{20}Ti_{20}$ | 2078 | 135 | 2.1 | 620 |
| Inventive Example 10 | $Cu_{60}Hf_{10}Ti_{30}$ | 2260 | 126 | 1.8 | 650 |
| Inventive Example 11 | $Cu_{55}Hf_{30}Ti_{15}$ | 2175 | 114 | 2.0 | 681 |
| Inventive Example 12 | $Cu_{60}Zr_{15}Hf_{15}Ti_{10}$ | 2100 | 121 | 2.4 | 640 |

TABLE 2-continued

| | Alloy Composition (at %) | σ f (MPa) | E (GPa) | ϵ (%) | Hv |
|---|---|---|---|---|---|
| Inventive Example 13 | $Cu_{60}Zr_{10}Hf_{10}Ti_{20}$ | 2110 | 136 | 2.2 | 647 |
| Inventive Example 14 | $Cu_{60}Zr_{28}Ti_{10}Nb_2$ | 2204 | 129 | 2.0 | 574 |
| Inventive Example 15 | $Cu_{60}Zr_{27}Ti_{10}Sn_3$ | 2145 | 125 | 1.8 | 519 |
| Inventive Example 16 | $Cu_{60}Zr_{27}Ti_{10}Ni_3$ | 2130 | 128 | 2.1 | 556 |
| Inventive Example 17 | $Cu_{60}Zr_{25}Ti_{10}Ni_5$ | 1915 | 113 | 2.4 | 531 |
| Comparative Example 1 | $Cu_{70}Zr_{20}Ti_{10}$ | | | | 564 |
| Comparative Example 2 | $Cu_{70}Hf_{20}Ti_{10}$ | | | | 624 |
| Comparative Example 3 | $Cu_{60}Zr_{20}Ti_{10}Ni_{10}$ | | | | 578 |

TABLE 2-continued

| | Alloy Composition (at %) | σ f (MPa) | E (GPa) | ϵ (%) | Hv |
|---|---|---|---|---|---|
| Comparative Example 4 | $Cu_{60}Ti_{40}$ | | | | 566 |

As seen in Table 2, each of the amorphous alloys of Inventive Examples exhibited a compressive fracture strength (σf) of 1800 MPa or more, an elongation (ϵ) of 1.5% or more, and a Young's modulus (E) of 100 GPa or more.

Further, for each of materials having alloy compositions as shown in Table 3 (Inventive Examples 18 to 32 and Comparative Examples 5 to 8), a corresponding mother alloy was molten through an arc-melting process, and then a rod-shaped sample with an amorphous single phase was prepared through a metal mold casting process. Then, the critical thickness and the critical diameter of the rod-shaped sample were measured. A compression test piece was also prepared for each of the above materials, and the test piece was subjected to a compression test using an Instron-type testing machine to evaluate the compressive fracture strength (σf). These results are shown in Table 3.

TABLE 3

| | Alloy Composition (at %) | Compressive Fracture Strength (σ f) (MPa) | Critical Thickness Critical Diameter* (mm) |
|---|---|---|---|
| Inventive Example 18 | $Cu_{58}Zr_{20}Hf_{10}Ti_{10}Gd_2$ | 2000 | 3 |
| Inventive Example 19 | $Cu_{58}Zr_{20}Hf_{10}Ti_{10}Al_2$ | 2200 | 3 |
| Inventive Example 20 | $Cu_{58}Zr_{20}Hf_{10}Ti_{10}Sn_2$ | 2200 | 4 |
| Inventive Example 21 | $Cu_{58}Zr_{20}Hf_{10}Ti_{10}Ta_2$ | 2250 | 4 |
| Inventive Example 22 | $Cu_{58}Zr_{20}Hf_{10}Ti_{10}W_2$ | 2300 | 3 |
| Inventive Example 23 | $Cu_{60}Zr_{29}Ti_9Gd_2$ | 2150 | 4 |
| Inventive Example 24 | $Cu_{60}Hf_{24}Ti_{14}Y_2$ | 2400 | 5 |
| Inventive Example 25 | $Cu_{60}Hf_{24}Ti_{14}Gd_2$ | 2430 | 3 |
| Inventive Example 26 | $Cu_{58}Zr_{29}Ti_9Fe_2Y_2$ | 2000 | 3 |
| Inventive Example 27 | $Cu_{58}Zr_{29}Ti_9Cr_2Gd_2$ | 2300 | 3 |
| Inventive Example 28 | $Cu_{58}Hf_{24}Ti_{14}Mn_2Y_2$ | 2100 | 2 |
| Inventive Example 29 | $Cu_{58}Zr_{28}Ti_9Fe_2Y_2Ag_1$ | 2100 | 3 |
| Inventive Example 30 | $Cu_{58}Zr_{28}Ti_9Cr_2Gd_2Au_1$ | 2100 | 3 |
| Inventive Example 31 | $Cu_{58}Hf_{22}Ti_{14}Mn_2Y_2Pd_2$ | 2210 | 4 |
| Inventive Example 32 | $Cu_{58}Zr_{18}Hf_{10}Ti_{10}Gd_2Pt_2$ | 2300 | 5 |
| Comparative Example 5 | $Cu_{70}Zr_{20}Ti_{10}$ | | *0.100 |
| Comparative Example 6 | $Cu_{70}Hf_{20}Ti_{10}$ | | *0.100 |
| Comparative Example 7 | $Cu_{75}Zr_{15}Ti_{10}$ | | *0.050 |
| Comparative Example 8 | $Cu_{75}Hf_{15}Ti_{10}$ | | *0.050 |

As seen in Table 3, the critical thickness in Comparative Examples is 0.1 mm at the highest, whereas Inventive Examples have a critical thickness of 2 mm or more, and a compressive fracture strength of 2000 MPa or more. This result verifies that Inventive Examples added with rare earth elements represented by M in the aforementioned formula can be formed as an amorphous alloy excellent in glass-forming ability and mechanical properties.

INDUSTRIAL APPLICABILITY

As mentioned above, according to the Cu-base amorphous alloy composition of the present invention, a rod-shaped sample having a diameter (thickness) of 1 mm or more can be readily prepared through a metal mold casting process. The amorphous alloy exhibits a supercooled liquid region of 25 K or more, and has high strength and Young's modulus. Thus, the present invention can provide a practically useful Cu-base amorphous alloy having a high glass-forming ability as well as excellent mechanical properties and formability.

What is claimed is:

1. A method of making a Cu-base bulk amorphous alloy product comprising:

preparing an alloy melt consisting essentially of a composition represented by the following formula: $Cu_{100-a-b}(Zr+Hf)_aTi_b$, wherein a and b are atomic percentages falling within the following ranges: $30<a\leqq35$, $10\leqq b\leqq15$, $40\leqq a+b\leqq45$, casting said alloy melt into a copper mold at an injection pressure of 0.5 to 1.5 kg·f/cm$^2$ and solidifying in the mold, thereby obtaining a rod or plate product having a diameter or thickness of 1 mm to 4 mm, wherein said rod or plate product has an amorphous phase of 90% or more by volume fraction, and wherein said rod or plate product has a compressive fracture strength of 1800 MPa or more, an elongation of 1.5% or more, and a Young's modulus of 100 GPa or more, wherein a supercooled liquid region of said amorphous phase has a temperature interval ΔTx of 25 K or more, said temperature interval being presented by the following formula: ΔTx=Tx−Tg, Tx being a crystallization temperature of said alloy, and Tg being a glass transition temperature of said alloy, wherein said alloy melt has a reduced glass transition temperature of 0.56 or more, said reduced-glass transition temperature being represented by the following formula: Tg/Tm, wherein Tg is a glass transition temperature of said alloy, and Tm is a melting temperature of said alloy.

2. The method of making a Cu-base amorphous alloy product as defined in claim 1, wherein said a and b are atomic percentage falling within the following ranges: $30<a\leqq35$, b=10, $40\leqq a+b\leqq45$.

3. The method of making a Cu-base amorphous alloy product as defined in claim 1, wherein said a and b are atomic percentage falling within the following values: a=30, b=10, a+b=40.

4. The method of making a Cu-base amorphous alloy product as defined in claim 1, wherein said a and b are atomic percentage falling within the following values: a=35, b=10, a+b=45.

* * * * *